US005251393A

United States Patent [19]

Gallone

[11] Patent Number: 5,251,393

[45] Date of Patent: Oct. 12, 1993

[54] LUMINOUS DISPLAY DEVICE FOR ELECTRIC EQUIPMENTS

[76] Inventor: Cesare Gallone, Signal Lux S.p.A. Via Milano 27, 20010 Cornaredo MI, Italy

[21] Appl. No.: 804,438

[22] Filed: Dec. 10, 1991

[30] Foreign Application Priority Data

Mar. 22, 1991 [IT] Italy ..... MI91 U 000240

[51] Int. Cl.[5] ..... G09F 9/00

[52] U.S. Cl. ..... 40/448

[58] Field of Search ..... 40/448

[56] References Cited

U.S. PATENT DOCUMENTS

| | | | |
|---|---|---|---|
| 3,927,375 | 12/1975 | Lanoe et al. | 362/103 X |
| 4,021,945 | 5/1977 | Sussman | 40/448 |
| 4,231,034 | 10/1980 | Bechteler | 40/448 X |
| 4,444,999 | 4/1984 | Sparrevohn | 379/387 X |
| 4,502,761 | 3/1985 | Knoll et al. | 359/48 |
| 4,586,659 | 5/1986 | Yokoi et al. | 40/448 X |
| 4,769,639 | 9/1988 | Kawamura et al. . | |
| 5,025,355 | 6/1991 | Harwood | 362/147 |

FOREIGN PATENT DOCUMENTS

| | | | |
|---|---|---|---|
| 0314084 | 5/1989 | European Pat. Off. . | |
| 2543340 | 9/1984 | France . | |
| 3-107889 | 5/1991 | Japan | 40/448 |
| 1370693 | 10/1974 | United Kingdom | 40/448 |
| 1527326 | 10/1978 | United Kingdom . | |
| 2088110 | 6/1982 | United Kingdom | 40/448 |

*Primary Examiner*—Laurie K. Cranmer

*Attorney, Agent, or Firm*—Laff, Whitesel, Conte & Saret

[57] ABSTRACT

The device consists of a container (1) within which a light source (2 and 3) is housed and on top of which a board (6) carrying silk-screen printed alphanumeric characters or symbolisms (7 to 13) is disposed; interposed between said container (1) and silk-screen printed board (6) is a liquid crystal board (14) in which the liquid crystals (15), through a reduction circuit, are activated to a low voltage and made transparent or opaque to the underlying light source (2 and 3) in order to highlight said alphanumeric characters (7 to 13) silk-screen printed on said board (6), or not.

3 Claims, 2 Drawing Sheets

LUMINOUS DISPLAY DEVICE FOR ELECTRIC EQUIPMENTS

BACKGROUND OF THE INVENTION

1. Field of the Invention

The present invention relates to a luminous display device for electric equipments of the type comprising a base container, within which a light source is disposed and on top of which a board carrying silk-screen printed alphanumeric characters is positioned which is slightly translucent at the lower part thereof.

2. Prior Art

It is known that all electric equipments are provided with a control board for the display and programming of the functions accomplished by each individual machine. It is in fact important to be able to inform the user about the operating state of the equipment, by indicating the noteworthy parameters of each function in a precise manner at the moment that said function is being accomplished (program, time, temperature, etc.).

This type of requirement has been mainly felt in the field of household users where control and indication boards are normally applied to the various equipments, such as for example washing machines, dishwashers, etc.

Up to now warning lights consisting of lamps sometimes of different colours have been mainly used.

In greater detail the operating indications of an equipment are accomplished by means of lamps that, being lighted by turns depending upon requirements, highlight a respective character or symbolism under which they are positioned. It is therefore apparent that it is necessary to use as many lamps as the required characters and that in case of long symbolisms, such as indication words or the like, the number of lamps needed would be so high that their use has not been considered advisable until now.

On the other hand it is to be pointed out that it is important to be able to identify the operating step of an equipment in a quick and precise manner.

However, at the present state of the art, as above said, it is not possible to carry out the display of expressions, numbers and symbolisms normally present on the control boards of equipments in a simple and quick manner as regards circuits and construction, by means of a cheap engineering technique.

In fact electronic displays also involving the use of liquid crystals need an appropriate input signal and the display of a complicated and relatively expensive electronic decoder.

SUMMARY OF THE INVENTION

The object of the present invention is therefore to overcome the limits of the known art by providing a luminous display device for electric equipments in which liquid crystal displays can be used which are provided with a very reduced circuitry and a low voltage enabling a very wide use thereof and therefore an economically effective exploitation in the engineering field.

The foregoing and further objects that will become more apparent in the course of the following description are attained by a luminous display device for electric equipments, of the type comprising a base container within which a light source is housed and on top of which a board carrying silk-screen printed alphanumeric characters is positioned which is slightly translucent at the lower part thereof, wherein between said base container and said silk-screen printed board a liquid crystal board is positioned, said liquid crystals being susceptible of activation to a low voltage, through a reduction circuit, so as to be made transparent or opaque to the underlying light source, for the purpose of showing said alphanumeric characters or symbolisms silk-screen printed on said board, or not.

BRIEF DESCRIPTION OF THE DRAWINGS

Further features and advantages of the invention will be best understood from the detailed description of a preferred embodiment of a luminous display device for electric equipments given hereinafter by way of non-limiting example with reference to the accompanying drawings, in which.

DESCRIPTION OF THE PREFERRED EMBODIMENT

Figure 1:
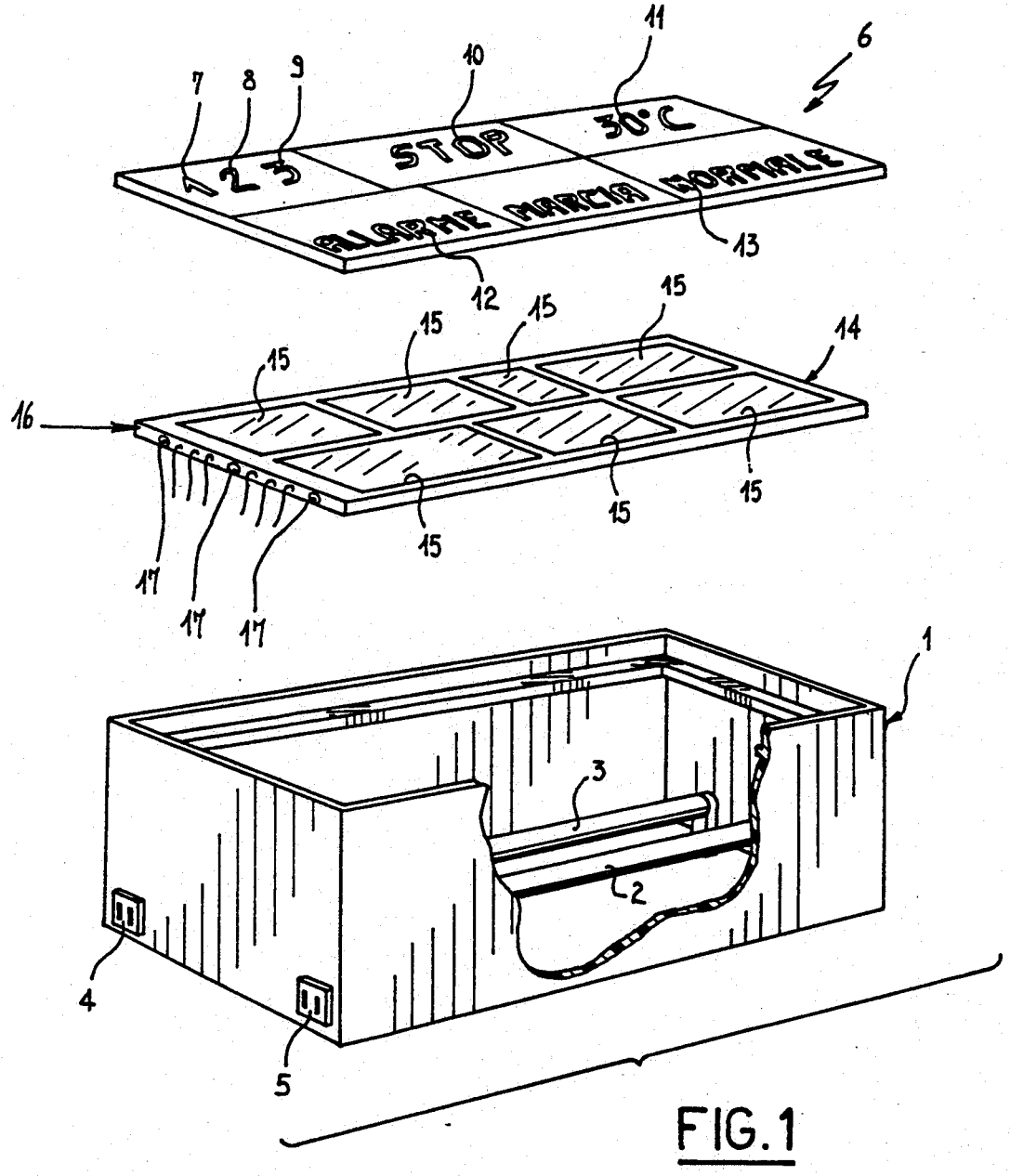
FIG. 1 is an exploded view of the parts forming the device of the present invention.

Referring to FIG. 1, a container substantially of parallelepiped form has been generally identified by reference numeral 1. Housed in said container is a light source, consisting for example of fluorescent lamps 2, 3, supplied through respective supply sockets 4 and 5 enabling them to be connected to the mains supply.

Lamps 2, 3 are always electrically activated.

Container 1 can be made for example of plastic material and can have the most appropriate shape to be conveniently housed in any equipment.

Disposed upon said container 1 so that the shapes of the respective perimetrical edges perfectly match each other is a board 6 carrying silk-screen printed alphanumeric symbolisms even of different colours.

The board 6 is slightly translucent at the lower part thereof and normally the alphanumeric characters are not highlighted. The alphanumeric characters shown on board 6 have been denoted by reference numerals 6, 8, 9, 10, 11, 12 and 13. Obviously these characters can represent any type of information.

Advantageously a board 14 on which liquid crystals 15 of different shapes and sizes have been disposed is located between said container 1 and said silk-screen printed board 6, said liquid crystals being connected in a circuit to a connector or terminal board denoted by 16, mounted to a perimetrical side of the board 14.

Figure 2:
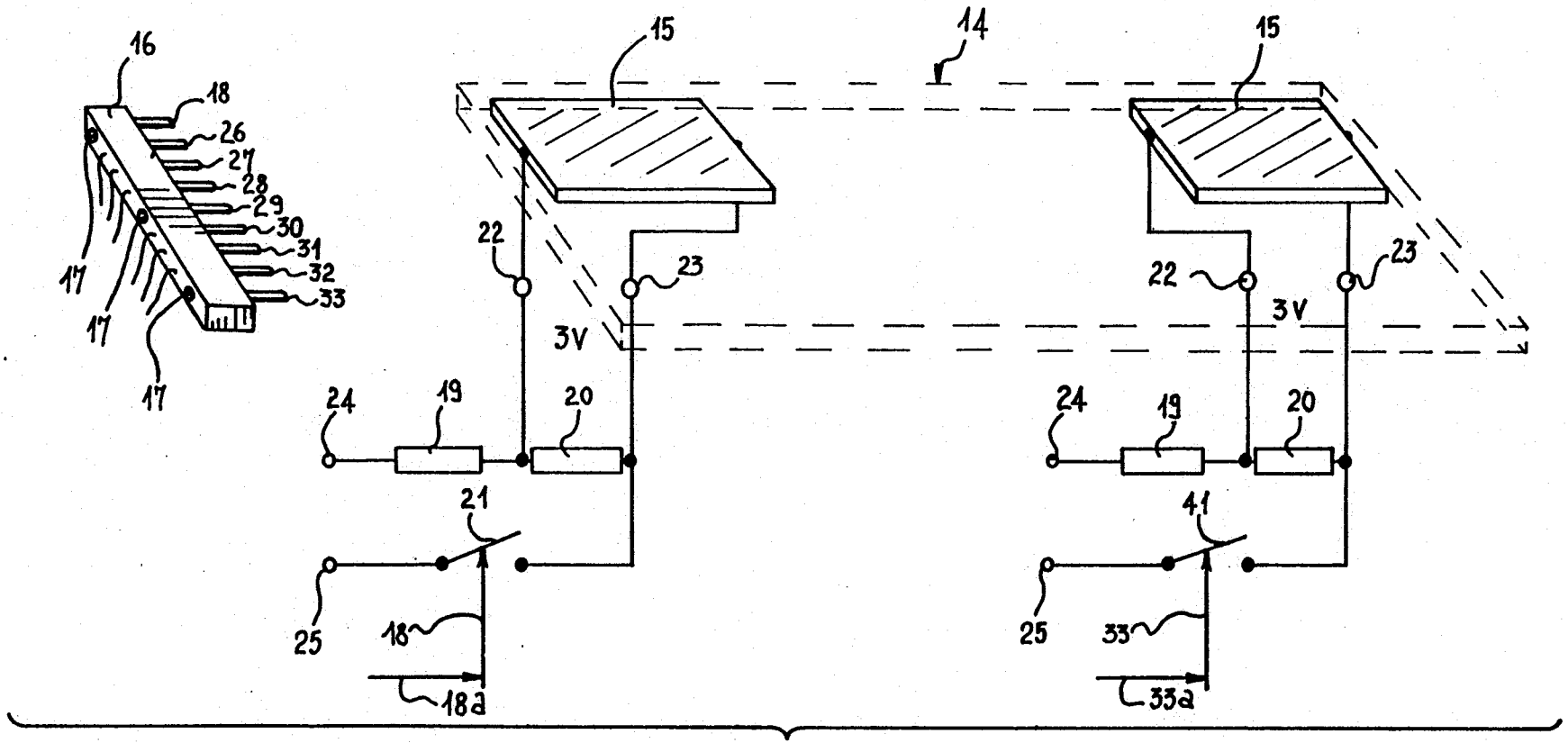
FIG. 2 is a diagrammatic view of the electric circuitry and the connections with the luminous displays of the invention.

Disclosed in FIG. 2 is the circuitry through which the liquid crystals 15 are activated.

The terminal board 16 exhibits inputs 17 on one side thereof and is provided on its opposite side, towards the liquid crystals, with connecting studs 18, 26, 27, 28, 29, 30, 31, 32 and 33, each of them being specific for a given function of the electric equipment with which the device is associated, and the purpose of which is to highlight, through a liquid crystal 15, one or more symbolisms corrispondently represented on the silk-screen printed board 6, as more clearly specified in the following.

Obviously inputs 17 and connecting studs 18, 26, 27, 28, 29, 30, 31, 32 and 33 can be of a variable number depending upon the functions to be taken into account.

More specifically, as shown in FIG. 2, each liquid crystal 15 can be excited or not in the circuit, by a low voltage applied thereto, for example on the order of 3 or 5 volt.

Said 3 or 5 volt voltage is obtainable since it is possible to achieve voltage drops between 2 and 5 volts.

Only two of the liquid crystals 15 present on board 14 have been highlighted by way of example but obviously the same system is effective for all the others.

Input terminals identified by 24 and 25 are provided for each liquid crystal 15 and they serve to pick up the mains voltage, for example a 220 volt voltage.

Following the circuit, it is noted that each liquid crystal is then assembled to output terminals denoted by 22 and 23.

The 3 volt voltage is obtained by a resistor bridge identified in the figure by resistances 19 and 20. By means of this resistor bridge 19 and 20 it is possible to pass from the mains voltage, for example a 220 volt voltage, to a 3 volt voltage.

Obviously this circuitry, as shown in the figure, is activated only and exclusively when a corresponding contact 21, being part of the electric equipment, is closed for the passage of current.

This normally open contact is closed when a signal 18*a* comes from the terminal board 16 and more particularly from the connecting stud 18, for example.

This signal, sent from the electrical equipment with which the device is associated, identifies a given function and consequently selects one or more liquid crystals making them transparent and therefore enabling the passage therethrough of the light coming from lamps 2 and 3, so that the corresponding symbolism superposed on the board 6 appears highlighted. The same reasoning is valid for the other liquid crystal 15 shown in FIG. 2, where there is a corresponding contact 41 that is activated by a corresponding signal 33*a* sent, as already said, from the electric equipment with which the circuit is associated, coming from connecting 33 in the terminal board 16.

In this manner by making each liquid crystal transparent to the underlying light, when necessary, the corresponding symbolism located on the board 6 is optically highlighted and consequently the function that is being performed at the moment by the electric equipment to which the device 1 is connected can be easily identified by an external observer.

Contacts 21 and 41 are external to the board 14 but in the diagram of FIG. 2 they have been shown at the inside of the circuitry relating to each individual liquid crystal 15, for simplification purposes.

In short, the essential principle on which the device under examination is based consists in using a light source which is always electrically activated to cause the passage of light from the source through a liquid crystal barrier towards one of the silk-screen printed boards 6, or not. This light passage can take place or not depending on whether these liquid crystals are made transparent or not, which in turn depends on requirements of displaying the function that at the moment is being performed by the electric equipment with which the inventive device is associated.

The invention attains the intended purposes.

In fact the device enables a great number of specific configurations to be accomplished for each equipment with which the device is associated and solves all problems relating to displaying and control functions; all that is obtained by virtue of a single light source, which is always electrically activated, the light emission of which, depending upon requirements, will highlight the alphanumeric characters or symbolisms disposed on the board 6, or not, depending on whether the corresponding liquid crystal interposed therebetween is excited or not.

Obviously structural and parametric variations can be made to the invention as conceived, all of them falling within the scope of the inventive idea.

What is claimed is:

1. A luminous display device for electric equipment comprising:

a base container housing a light source, and on top of said base container a board having silk-screen printed alphanumeric characters or symbolisms is positioned, said board being partially slightly translucent, a liquid crystal board positioned between said light source and said board with said silk-screen printed alphanumeric characters or symbolisms, liquid crystals in said liquid crystal board which provide an optical barrier for light from the light source towards the silk-screen printed board, the symbolisms of which highlight operation modalities of said equipment, said liquid crystals being susceptible of activation to a low voltage in order to be made transparent or opaque to the underlying light source, said light source being always electrically activated to cause or inhibit the passage of a luminous beam from the underlying light source for highlighting or not highlighting said symbolisms.

2. A device according to claim 1, wherein each individual liquid crystal of said device is supplied with a low voltage determined by a voltage reduction circuit by causing a contact, located externally of the electric equipment, to be opened or closed, said electrical equipment carrying out said opening or closing by sending or not sending an identification signal to an input terminal board of said liquid crystals, said signal identifying a specific function selecting and activating one or more liquid crystals, making them transparent for enabling the corresponding passage of light from the underlying light source for carrying out the highlighting of the corresponding symbolism on the silk-screen printed board, said signal making readily detectable the function that at a moment is accomplished by the electric equipment to which the device is connected.

3. A device according to claim 1 wherein there is a connection between a voltage reduction bridge for each liquid crystal, and the electric equipment is formed with an inlet terminal board provided with connecting studs coming from the equipment and each connecting stud specific for a given operation modality of the equipment itself with which the device is associated, to permit a direct electric connection between each liquid crystal and each function to be highlighted for the operation modalities of the electric equipment, said connection causing the electric circuitry to be closed by a terminal board for said liquid crystals wherein said liquid crystals thereby close the electric circuit towards the equipment of which they are an integral part, and including closing-opening contacts that cause the activation or inactivation of the liquid crystals which are physically and serially connected to said liquid crystal inlet terminals.

* * * * *